United States Patent [19]

Hlaing

[11] Patent Number: 4,969,644

[45] Date of Patent: Nov. 13, 1990

[54] TENSION-TYPE EXERCISE DEVICE

[76] Inventor: Terence Hlaing, 11312 Hounds Way, Rockville, Md. 20852

[21] Appl. No.: 453,799

[22] Filed: Dec. 20, 1989

[51] Int. Cl.[5] ..... A63B 21/055

[52] U.S. Cl. ..... 272/142; 272/137

[58] Field of Search ..... 272/67, 68, 125, 135–143

[56] References Cited

U.S. PATENT DOCUMENTS

| | | | |
|---|---|---|---|
| D. 232,368 | 8/1974 | Shales . | |
| D. 263,328 | 3/1982 | Cooper . | |
| 1,660,234 | 2/1928 | Pezuto . | |
| 1,832,633 | 11/1931 | Hendrickson | 272/142 |
| 2,224,103 | 12/1940 | Nilson | 272/142 X |
| 2,590,951 | 4/1952 | Farison | 272/142 |
| 3,640,526 | 2/1972 | Olorenshaw | 272/142 |
| 3,951,404 | 4/1976 | Brown | 272/142 |
| 4,033,580 | 7/1977 | Paris | 272/137 |
| 4,121,827 | 10/1978 | Weider | 272/137 |
| 4,199,140 | 4/1980 | Ferretti | 272/142 |
| 4,200,281 | 4/1980 | Wang | 272/138 |

FOREIGN PATENT DOCUMENTS

| | | | |
|---|---|---|---|
| 833418 | 2/1970 | Canada | 272/142 |

*Primary Examiner*—Robert W. Bahr

*Attorney, Agent, or Firm*—Terry M. Gernstein

[57] ABSTRACT

A tension exercise device of the chest pull type includes a flexible band that has flexible handles on each end thereof. The handles have grooves defined therein and a hand-hole defined therethrough. The hand-holes are oblong and somewhat egg shaped with a major axis extending along the length dimension of the band. The band is formed of lightweight material, such as latex, and the handles are also formed of elastomeric material.

15 Claims, 2 Drawing Sheets

TENSION-TYPE EXERCISE DEVICE

TECHNICAL FIELD OF THE INVENTION

The present invention relates to the general art of exercise devices, and to the particular field of tension-type exercise devices.

BACKGROUND OF THE INVENTION

As more and more people realize the benefits of regular exercise, exercise devices become more and more popular. Accordingly, the art now includes a wide variety of exercise devices. Some of these devices are quite simple, such as simple dead weights, and some of these devices are quite complex, such as the large machines that are intended to exercise a variety of muscles.

One form of exercise device that has been known for some time is the chest pull type device in which the user grasps a handle in at least one hand and pulls against tension. Such devices have been used to exercise chest muscles, back muscles and the like. Accordingly, the art has included several such devices.

While somewhat effective, these devices still have several drawbacks and shortcomings which vitiate the full and effective use thereof. For example, these devices are generally not amenable to easily providing a variety of different tensions so that a user is thus limited in the amount and type of exercise that can be performed.

Still further, these devices have several non-exercise related factors that further limit the use of such devices. For example, many present devices are not shaped to distribute force in a manner that provides comfort to the user's hands or feet during use. Accordingly, the use of these devices may be limited by the hand or foot fatigue or discomfort or by the device's inability to remain comfortably in place on a user's hand or foot, rather than muscle fatigue as should be the case. Still further, many of the present devices often irritate a user's skin during use due to frictional contact, as when the device is stretched across the user's back. Such irritation may limit the use of the device thereby, again, affecting the use rather than muscle fatigue.

Such non-muscle exercising factors should not limit an exercise routine if an exercise device is to be totally effective and efficient.

Yet another drawback of the present devices is the possibility of sudden failure. For example, should the spring element on some devices partially separate from the handle, such separation may create forces that tend to cause total separation of the spring from the handle in a sudden manner. Such sudden failure is not desirable.

Yet a further drawback of many presently available exercise devices is the bulky nature thereof. The springs are bulky and the handles are stiff. This makes the device "gym bound", that is, the device is not readily packed, stored, and transported in a suitcase or in a briefcase or the like. Such "gym bound" nature prevents a user from taking the device on trips whereby such trips may interrupt the user's exercise routines. As is well known, exercise produces best results if carried out on a regular basis. The "gym bound" nature of such devices inhibits such routines.

Accordingly, there is a need for a hand-held tension-type exercise device which is comfortable to use, can have the force distribution pattern thereof easily altered, yet should it partially fail, it is not likely to fail in a total manner, and is easily packed, stored and transported in a small case.

OBJECTS OF THE INVENTION

It is a main object of the present invention is to provide a hand-held tension-type exercise device which is comfortable to use whereby time of use is limited by muscle factors rather than by non-muscle fatigue factors, such as skin irritation or hand or ankle discomfort.

It is another object of the present invention to provide a hand-held tension-type exercise device which is comfortable to use, and can have the force distribution pattern thereof easily altered whereby a wide variety of exercises can be carried out using a single simple device.

It is another object of the present invention to provide a hand-held tension-type exercise which is comfortable to use, and can have the force distribution pattern thereof easily altered, yet should it partially fail, it is not likely to fail in a total manner.

It is another object of the present invention to provide a hand-held tension-type exercise device which is comfortable to use, and can have the force distribution pattern thereof easily altered, yet should it partially fail, it is not likely to fail in a total manner, and is easily packed, stored and transported whereby a user need not have his or her exercise routine disrupted due to travel or the like.

SUMMARY OF THE INVENTION

These, and other, objects are achieved by a hand-held tension type exercise device which is extremely light and flexible and which includes a latex resistance band having a flexible elastomeric handle on each end thereof. In one embodiment of the device, the handles are bonded to the band, and in another embodiment, the handles and the band are monolithic and one-piece. The handles include hand holes that are shaped to provide comfort to the user's hand or foot as the device is used.

The flexible nature of the handles is enhanced by grooves and increases the comfort of using the device so that use is limited by muscle fatigue and not by hand or ankle discomfort. The thin latex used to form the tension band prevents contact between that band and the user's body from being irritating to the user'skin, again removing such non-muscle fatigue factors such as skin irritation which tend to limit the length of an exercise period. The light nature of the handles and the tension band also make the device easy to fold up for packing and storing in small areas, such as in a briefcase or the like so the device can be easily taken on trips or the like.

The latex band and the handles are of the same width to provide good force distribution for the device, and the device is easily modified to change workout exercises.

BRIEF DESCRIPTION OF THE DRAWING FIGURES

DETAILED DESCRIPTION OF THE PREFERRED EMBODIMENT OF THE INVENTION

Figure 1:
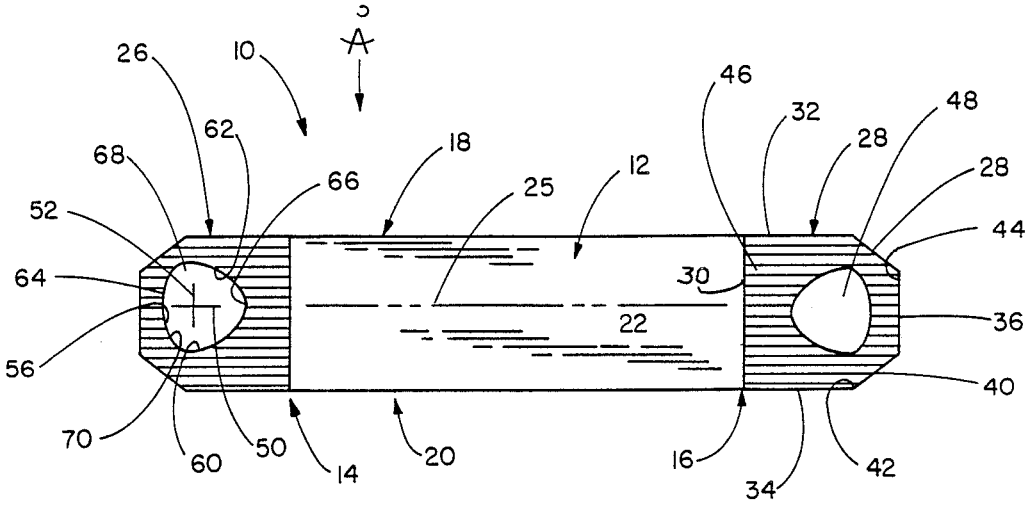
FIG. 1 is a top plan view of a hand-held tension type exercise device embodying the present invention.

Shown in FIG. 1 is a hand-held tension-type exercise device 10 embodying the present invention. The device 10 includes a light-weight flexible tension band 12 which is formed of a light-weight elastomeric material, such as latex or the like. The band 12 includes ends 14 and 16 and sides 18 and 20, with a length dimension being defined to extend between the ends 14 and 16 and a width dimension being defined to extend between the sides 18 and 20. The band also includes a top surface 22, and a bottom surface, with a thickness dimension being defined between the top and bottom surfaces. In a preferred form of the device, the untensioned length dimension is approximately twenty inches, the width dimension is approximately six inches, and the thickness dimension is approximately one-sixteenth of an inch. However, other dimensions can be used as necessary. For example, a child's version of the device may be shorter than the justmentioned version, and the thickness of the band can be varied to define various tensions. Accordingly, no limitation is intended by the above recitation of dimensions. The band 12 also has a longitudinal centerline 25 that extends along the length dimension of the band.

The device 10 includes a handle on each end of the band as indicated by handles 26 and 28. The handles are identical, and each handle includes six sides, with a first side 30 that is located adjacent to a band end, two sides 32 and 34 that are colinear with the band sides 18 and 20 respectively, an outer side 36 that is parallel with the first side 30, and two sides 38 and 40 that intersect the sides 32, 36 and 40 at oblique angles, such as angles 42 and 44. Each of the handles includes a width dimension extending between the sides 32 and 34 that is equal to the width dimension of the band 12, and a length dimension extending between sides 30 and 36 and a longitudinal centerline that extends along the length dimension of the handle and is colinear with the band longitudinal centerline 25. The handles thus form a continuation of the band and have the same width as that band.

A multiplicity of grooves, such as groove 46, are defined in the handles on both the top and bottom surfaces of the device, to extend along the length dimension of the band. The grooves are spaced apart from each other along the width dimension of the handle, and add flexibility to the handles. The angled nature of the sides 38 and 40 with respect to the sides 32, 34 and 36 also tends to control force distribution in the handle during use.

Each handle also includes an oblong hand hole 48 that has a major axis 50 co-linear with the band longitudinal centerline 25, and a minor axis 52 that is perpendicular to that major axis and is located to intersect the intersection of sides 32 and 38 and the sides 34 and 40. The oblong hand holes 48 can be described as being roughly egg shaped and have a large end 56 located adjacent to the handle side 36, and as small end 58 located adjacent to the handle side 30. The hole is formed by curved edges 60, 62 and 64 which intersect at corners 66, 68 and 70 to give the egg shape a triangular format. The hole is defined so that the longitudinal centerline of the band intersects the corner 66 and bisects the curved edge 56. The location, orientation and size of the hand holes are selected to provide maximum comfort to the handles, and to co-operate with the grooved and flexible nature of the handles during use to permit the handles to flex and distribute forces to the user's hand or ankle in a manner that prevents undue stress from being placed on the hand or ankle.

The grooves also permit the user to gain a secure grip, either using his hand or his ankle, on the handle and thus prevent slipping during some exercises. The shape of the hand holes permits the user to gain a secure grip on the handle and is also amenable to a secure and comfortable contact between the handle and the user's ankle, while the tapered shape of the handles created by the angled sides 38 and 40 also contributes to the comfort of the user's grasp on the handle. The oval shape of the handle holes also tends to distribute forces to the handle in a manner that better protects those handles from damage than if the holes contained sharp edges.

Since the band 12 is the same width as the handles, forces between the band and the handles are better distributed to the handle than if the band were not as wide as the handles. The band being formed of latex also makes that band light and easy to fold for storing the device and contact between the band and the user's body, for example, his back, during an exercise will not cause irritation of the user's skin due to friction. Furthermore, latex is not likely to fail catastrophically if a small rip or hole is torn in the band. Thus, a user should be able to spot a potential problem before using the device.

Figure 2:
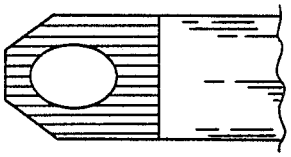
FIG. 2 is a partial top plan view of the exercise device in the deformed, use condition.
Figure 3:
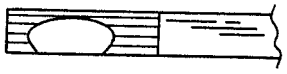
FIG. 3 is a partial side elevational view of the exercise device in the deformed, use condition.

The flexing feature of the device is illustrated in FIGS. 2 and 3. As the device is pulled against the tension of the band in the direction of the longitudinal centerline 25, the handles flex and deform, as indicated in these figures, so the handle curves around the longitudinal centerline so the hole 48 is deformed from the egg shape shown in FIG. 1 to an oval shape shown in FIG. 2. FIG. 3 shows a view of the device taken from side 18 as indicated in FIG. 1 to further show the curved nature of the device when it is tensioned. By comparing FIGS. 1 and 2, it can also be seen that the width dimension of the device tends to decrease as well. By deforming about the longitudinal centerline, the forces on the band are also efficiently distributed and absorbed by the band.

Figure 4:
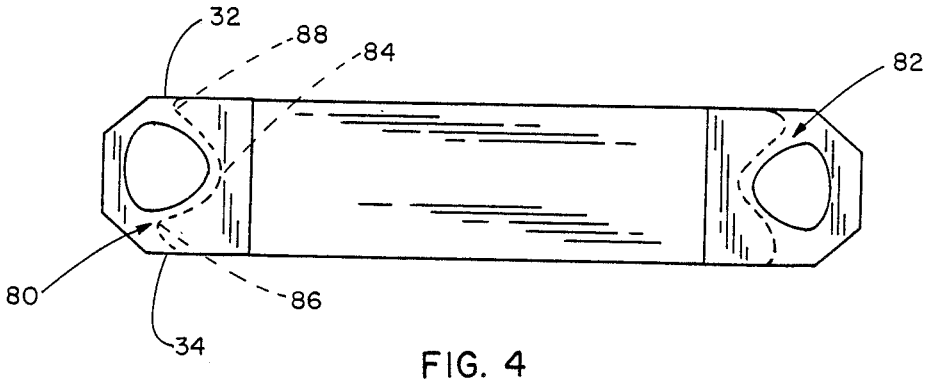
FIG. 4 is a top plan view of one form of the device in which handles are bonded to a tension band.
Figure 5:
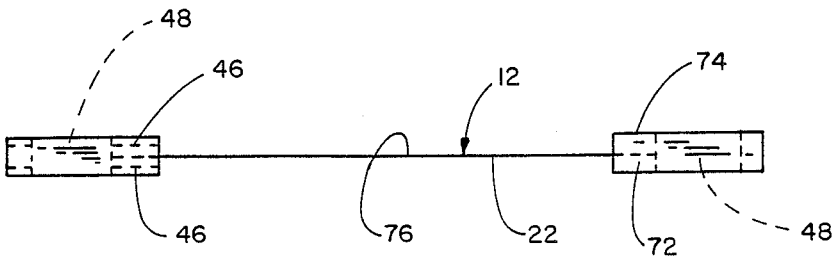
FIG. 5 is a side elevational view of the FIG. 4 bonded device.

One form of the device is monolithic and one-piece with the handles and the band being molded out of a single, monolithic element. Another form of the device is shown in FIGS. 4 and 5 as having the handles bonded to the band. Each of the handles includes a front plate-like element 72 located on the top surface 22 of the band, and a rear plate-like element 74 located on the bottom surface 76 of the band. The plate-like elements are all identical, and each has a shape and dimensions as discussed above for the handles 26 and 28, and also have cutouts which are configured, dimensioned and located to be congruent when the front and the rear plate-like elements are bonded in place on each end of the band to form the above-discussed hand holes 48. The plate-like elements are formed of elastomeric material, such as rubber, and have grooves defined therein so that both surfaces of the device will have grooves defined therein.

As shown in FIG. 4, the ends of the band include curved edges 80 and 82 which are roughly sinusoidal in shape to have a valley 84 defined between two peaks 86 and 88 which are located adjacent to the handle sides 32 and 34 respectively. The valley 84 is located adjacent to the small end of the hand-hole and the peaks are located between the hole and the handle sides. This positioning and orientation of elements provides great strength to the attachment of the band to the handles and distributes forces between the handles and the band in an efficient manner that protects the band from coming loose from the handles in use.

Figure 6:
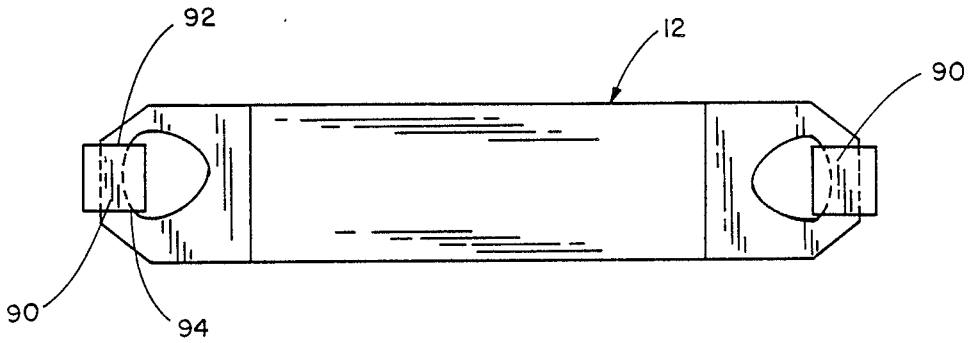
FIG. 6 is a top plan view of a device which includes handle covers.

Yet another form of the device is shown in FIG. 6 and includes cushions 90 on each handle to add further comfort to the use of the device. The cushions are sized to have a length dimension as measured between ends 92 and 94 that is essentially equal to the length dimension of the handle side 36 so further comfort is added to the device.

Figure 7:
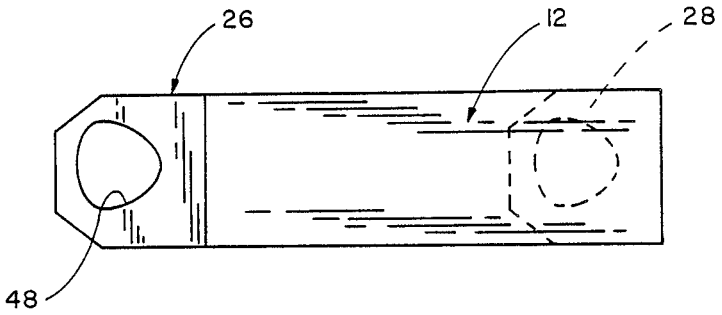
FIG. 7 is a top plan view of the device in a configuration which changes the distribution of forces in the device so that various exercises can be performed.

The device is amenable to several different configurations so that a wide variety of different exercises can be performed by quickly and easily altering the configuration of the device. One such variation is shown in FIG. 7 in which one of the handles has been folded under the band to shorten the band. A property of the band is that the amount of force required to stretch it increases as the band is stretched. Thus, by shortening the band by folding the handle underneath, requires a user to stretch the band further to reach the same point than if the handle were fully extended. Thus, exercising force can be varied by simply folding one or both of the handles into the band one or more times and trying to stretch the band the same distance as when the handles are deployed in the FIG. 1 positions. Other variations and uses of the device will occur to those skilled in the art based on the teaching of the present disclosure, and will not be discussed herein, but are intended to be embraced by the disclosure hereof.

It is understood that while certain forms of the present invention have been illustrated and described herein, it is not to be limited to the specific forms or arrangements of parts described and shown.

I claim:

1. A resistance-type exercising device comprising:

a monolithic, one-piece body having (1) a flexible resistance band having first and second ends, first and second sides with a width dimension defined between said sides and a length dimension extending between said ends, (2) a handle on each end of said band, each of said handles including (a) a plurality of grooves defined therein to extend along said band length dimension, (b) an oblong hand-accommodating hole defined through said handle and having a major axis extending lengthwise of said band, and (c) each handle being formed of flexible elastomeric material which co-operates with said grooves so that each handle is flexible to fold, in use, about the band longitudinal centerline.

2. The device defined in claim 1 wherein said each handle has a front surface and a rear surface and said grooves are defined in both said front and rear surfaces.

3. The device defined in claim 2 wherein said opening is triangular in shape.

4. A tension-type exercising device comprising:

(A) a flexible resistance band having a front surface a rear surface, first and second sides and first and second ends, a width dimension defined between said first and second sides, a length dimension defined between said first and second ends, and a thickness dimension defined between said front surface and said rear surface, said ends being sinusoidal in shape to have a valley between two peaks with each of said peaks being located adjacent to one of said band sides; and (B) two handle units, each handle unit including (1) a front plate-like element affixed to said band adjacent to each end of said band on said band front surface and a rear plate-like element affixed to said band adjacent to each end of said band adjacent to said band rear surface, each plate-like element having an oblong hole defined therethrough which has a major axis co-linear with said band longitudinal axis, and which is congruent with an oblong hole defined a plate-like element associated therewith to define a single oblong hole in each handle, (2) a multiplicity of grooves defined in each plate-like element to extend lengthwise of said band when said plate-like elements are affixed thereto, and (3) each plate-like element being formed of elastomeric material and being flexible about the band longitudinal axis to bend into a tubular configuration about such band longitudinal axis in use.

5. The device defined in claim 4 wherein said band is formed of latex.

6. The device defined in claim 5 wherein said thickness dimension is about one-sixteenth of an inch.

7. The device defined in claim 6 further including a cover on each handle unit.

8. The device defined in claim 7 wherein said plate-like elements are all formed of elastomeric material.

9. The device defined in claim 8 wherein each handle unit is polygonal in shape and has at least six sides.

10. The device defined in claim 9 wherein each of two of said handle six sides intersects adjacent sides at an oblique angle.

11. The device defined in claim 10 wherein two other handle unit sides of said six sides are co-linear with said resistance band first and second sides and another side of said handle unit six sides is located adjacent to one end of said resistance band and is parallel to a remaining side of said handle unit six sides.

12. The device defined in claim 11 wherein said oblong opening in each plate-like element is egg-shaped with a large end located adjacent to said remaining side, and a small end located adjacent to said resistance band one end.

13. The device defined in claim 12 wherein said egg-shaped opening large end is formed by a first curved edge, and said egg-shaped opening small end is formed by an intersection of two curved edges which also intersect said first curved edge.

14. The device defined in claim 13 wherein said flexible resistance band has a longitudinal centerline extending along said length dimension intermediate to said first and second sides and further wherein each of said handle unit plate-like elements has a centerline which is co-linear with said flexible resistance band longitudinal centerline, and said small end in each plate-like element openign is located on said plate-like element longitudinal centerline.

15. The device defined in claim 14 wherein each plate-like element longitudinal centerline bisects the first curved edge of the opening defined in said each plate-like element.

* * * * *